US005460113A

United States Patent [19]

Gunter

[11] Patent Number: 5,460,113

[45] Date of Patent: Oct. 24, 1995

[54] APPARATUS FOR ANCHORING A FLOTATION DEVICE

[76] Inventor: Terry L. Gunter, Rte. 4, Box 377, Bowie, Tex. 76230

[21] Appl. No.: 193,244

[22] Filed: Feb. 7, 1994

[51] Int. Cl.[6] ..... B63B 21/00

[52] U.S. Cl. ..... 114/230; 441/129

[58] Field of Search ..... 114/294, 230; 441/129; 482/55; 472/13

[56] References Cited

U.S. PATENT DOCUMENTS

| | | | |
|---|---|---|---|
| 2,850,252 | 9/1958 | Ford . | |
| 2,938,727 | 5/1960 | Nosak . | |
| 2,956,531 | 10/1960 | Banker | 114/230 |
| 3,014,723 | 12/1961 | Butler . | |
| 3,858,877 | 1/1975 | Lundstrom . | |
| 3,895,801 | 7/1975 | Baird . | |
| 3,988,020 | 10/1976 | Carter . | |
| 4,519,783 | 5/1985 | Burke, Jr. . | |
| 4,729,331 | 3/1988 | Eggleston | 114/230 |
| 4,775,346 | 10/1988 | Gunter | 441/129 |

OTHER PUBLICATIONS

"Velcro" ad from The Ships Store, catalog, 1981, p. 61.

*Primary Examiner*—Jesus D. Sotelo
*Attorney, Agent, or Firm*—Daniel V. Thompson

[57] ABSTRACT

An improved apparatus for anchoring a flotation device includes a strap member having two ends. An attachment clamp is connected to one of the ends of the strap member, and has opposed clamp surfaces for clamping the flotation device. An anchoring device is fixed to the other end of the strap member.

7 Claims, 3 Drawing Sheets

APPARATUS FOR ANCHORING A FLOTATION DEVICE

TECHNICAL FIELD

The present invention relates to flotation devices and in particular to an apparatus for anchoring a flotation device to a stationary object.

1. Background Art

Flotation devices, such as foam pads, rubber rafts, inflatable air mattresses and the like, are frequently used for recreational activities in the water. Such devices are typically comprised of closed-cell foam or individual airtight compartments for receiving pressure air to inflate the device to the desired buoyancy, so as to be able to support the weight of an adult and still remain afloat. Other devices, such as float chairs, may have one or more lighter-than-air flotation members manufactured out of such materials as expanded polystyrene (commonly known under the registered trademark Styrofoam).

Many people find it relaxing to recline on such flotation devices in the middle of a pool or small lake. Flotation devices, such as foam pads, inflatable air mattresses or float chairs, are often used by sunbathers.

One problem associated with the use of such pads, mattresses or float chairs in a swimming pool is that they will often drift into an area where there is unwanted commotion, such as diving or general "horseplay", which could result in the mattress chair being tipped over or at least in the disruption of the tranquility that one experiences when using the flotation device. Another problem associated with such flotation devices is that it is difficult to properly align the device to take advantage of the sun's position when one is engaged in sunbathing because the device tends to drift randomly in the water.

2. Description of the Prior Art

The prior art includes U.S. Pat. No. 4,775,346, of which I was co-inventor. Said patent is incorporated herein by reference. A drawback of the invention of this prior patent is that the hook and loop fasteners are troublesome to attach and loose effectiveness with repeated use. In addition, the hook and loop fastening system is not easily transferable between flotation devices. Another drawback of the prior patented device is the provision of a suction cup as the sole anchoring device limits its use to environments where smooth surfaces are available for anchoring. It is not possible to use the prior device to tether flotation devices to rough or non-flat surfaces, such as docks, piers, pilings, etc.

Thus, there presently exists a need for an improved mechanism for anchoring a flotation device.

SUMMARY OF THE INVENTION

An improved apparatus for anchoring a flotation device includes a strap member having two ends. An attachment clamp connected to one of the ends of the strap has opposed clamp surfaces for clamping the flotation device. An anchoring device is fixed to the other end of the strap.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION

Figure 1:
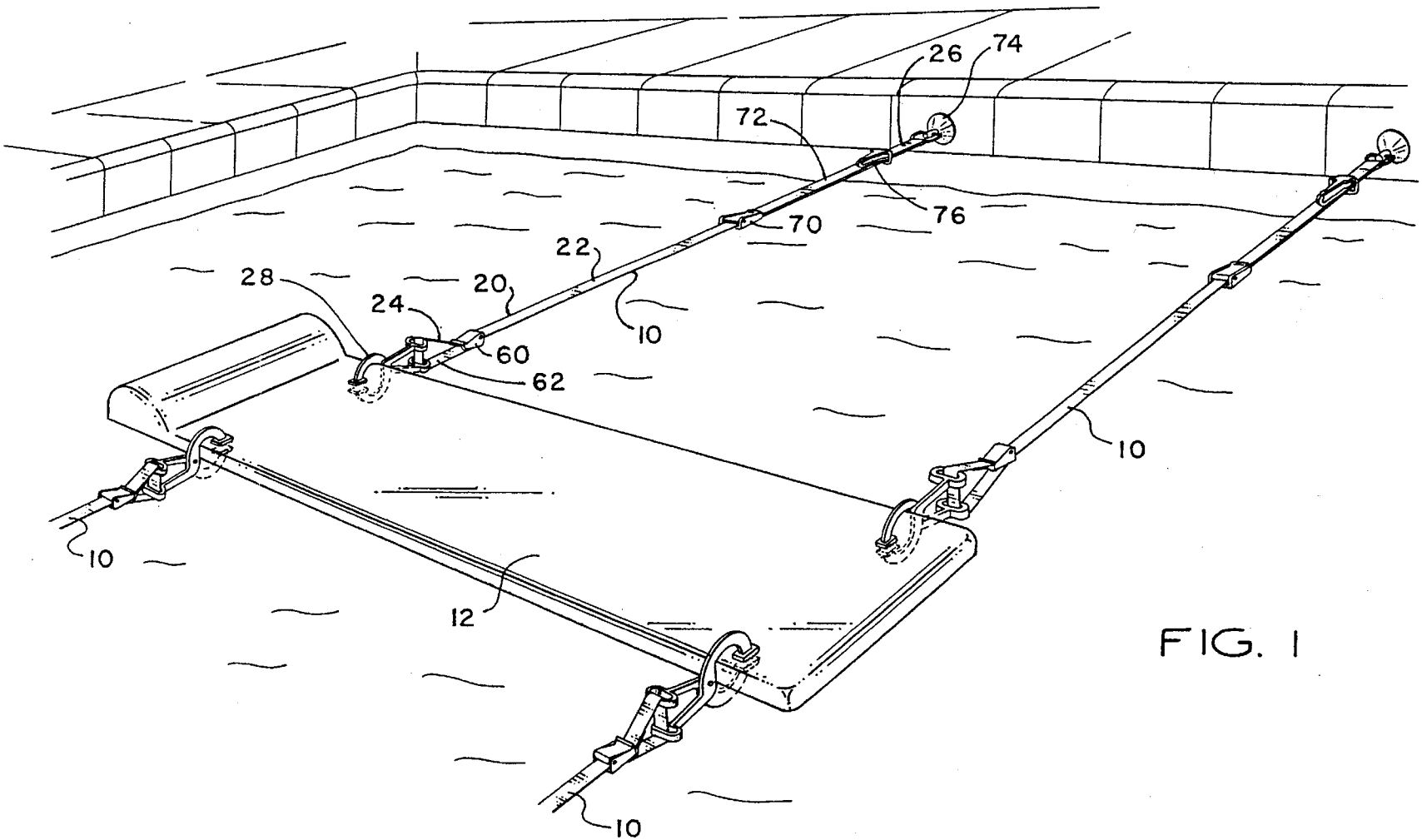
FIG. 1 is a perspective view of the apparatus of the present invention used in conjunction with a closed-cell foam flotation device.
Figure 2:
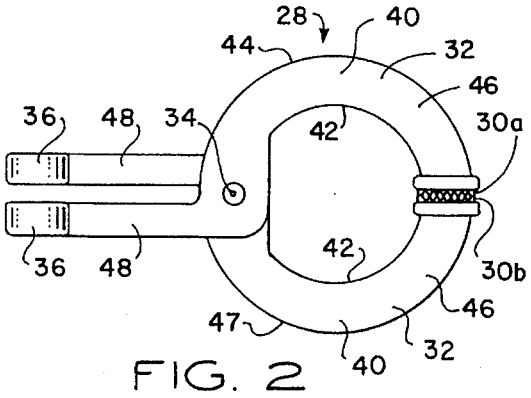
FIG. 2 is a side view of the attachment clamp of the present invention.

Referring to FIGS. 1–7, where like numerals refer to like and corresponding elements, an improved apparatus 10 for anchoring a flotation device 12 is usable in swimming pools, lakes and the like. While FIG. 1 illustrates form identical apparatus 10's in use, it will be readily apparent that some users will find a single apparatus 10 to be sufficient dependent on the particular environment.

Apparatus 10 includes a fabric web strap member 20 having a body 22 and first and second ends 24 and 26, respectively. An attachment clamp 28 is connected to first end 24 of strap member 20. Attachment clamp 28 has opposed clamp surfaces 30*a* and 30*b* for clamping flotation device 12.

Attachment clamp 28 has first and second identical scissors members 32 joined side by side by a hinge 34. Each scissors member 32 is preferably formed of thermoplastic. Each scissors member 32 includes one of the clamp surfaces 30*a* or 30*b* at one end and a strap attachment loop 36 at the other end. The hinge 34 is intermediate the two ends of the scissors members 28. In preferred form, each clamp surface 30*a*, 30*b* is block shaped and has a plurality of longitudinal ridges 38 to enhance the gripping ability of clamp surfaces 30*a*, 30*b*.

Figure 3:
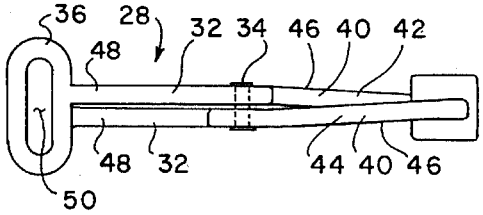
FIG. 3 is an overhead view of the attachment clamp of FIG. 2.
Figure 4:
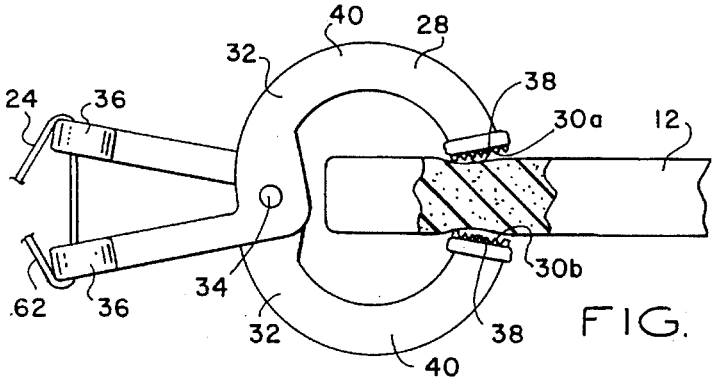
FIG. 4 is a side view of the attachment clamp engaged with a closed-cell foam flotation device.

Each scissors member 32 further includes a curved clearance portion 40 extending outwardly from clamp surfaces 30*a*, 30*b* and curving inwardly to hinge 34. Clearance portion 40 has circular inner and outer surfaces 42 and 44, respectively, and parallel, planar side surfaces 46. As best shown in FIG. 3, the clearance portions 40 are angled slightly inwardly from hinge 34 so that clamp surfaces 30*a* and 30*b* are opposed even though the scissors members are joined at hinge 34 in side by side fashion.

Each scissors member 40 has an arm 48 extending from hinge 34 to strap attachment loop 36. In preferred form, the strap attachment loop 36 is oblong in a direction perpendicular to arm 48 and parallel to hinge 34, as best shown in FIG. 3. Strap attachment loop 36 is connected to arm 48 at a location offset from the middle of strap attachment loop 36, such that openings 50 in strap attachment loops 36 are aligned, as shown in FIG. 3.

Strap member 20 is threaded through the strap attachment loops 36 and terminates at its first end 24 at a readily-disengageable first buckle 60 (FIG. 1). First buckle 60 is slidably-engaged with body 22 of strap member 20 to form an adjustable first loop 62 through strap attachment loops 36. The maximum opening between the clamp surfaces 30*a*, 30*b* is thus defined by the position of first buckle 60 with respect to body 22 of strap member 20.

Strap member 20 terminates at its second end 26 at a readily-disengageable second buckle 70. Second buckle 70 is slidably-engaged with body 22 of strap member 20 to form an adjustable second loop 72.

Figure 6:
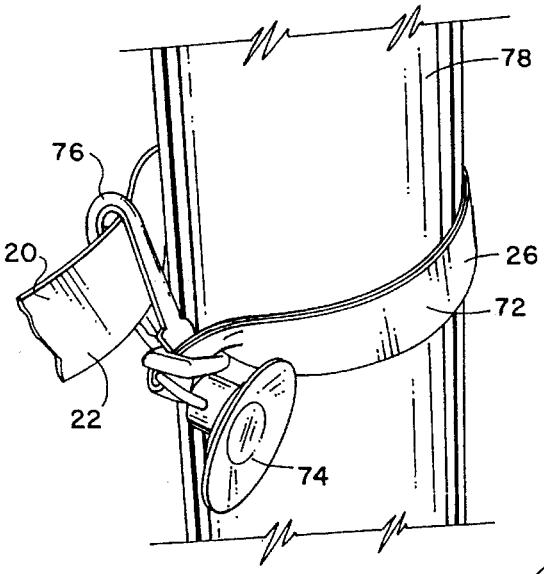
FIG. 6 is a view of the snap hook embodiment of an anchoring device.
Figure 5:
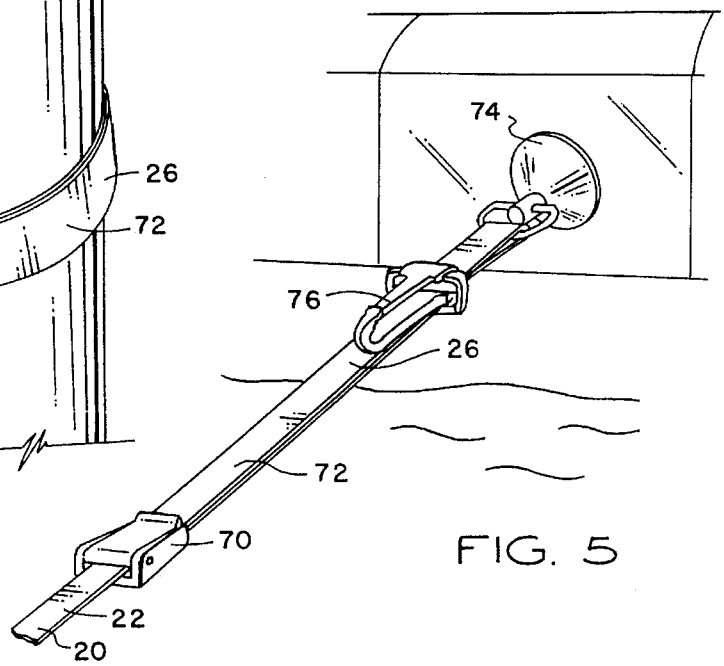
FIG. 5 is a view of the suction cup embodiment of an anchoring device.

As best shown in FIGS. 5 and 6, preferably two different anchoring devices are threaded on second loop 72. The anchoring devices may include a suction cup 74 and a snap hook 76. The overall length of strap member 20 between the anchoring devices 74, 76 is defined by the position of second buckle 70 with respect to body 22 of strap member 20.

As shown in FIGS. 1 and 5, the suction cup 74 can be utilized as in the prior patent to effect anchoring to smooth flat surfaces such as pool-side tile. Alternatively, when connection to a rough and/or non-flat surface such as piling 78 is desired, the snap hook 76 can be utilized as shown in FIG. 6. It will be recognized that the snap hook anchoring technique is substantially more secure than the suction cup technique. It will also be appreciated that only one anchoring device of selected construction need be utilized, and the provision of two alternate anchoring devices in the preferred embodiment is solely to enhance versatility.

Figure 7:
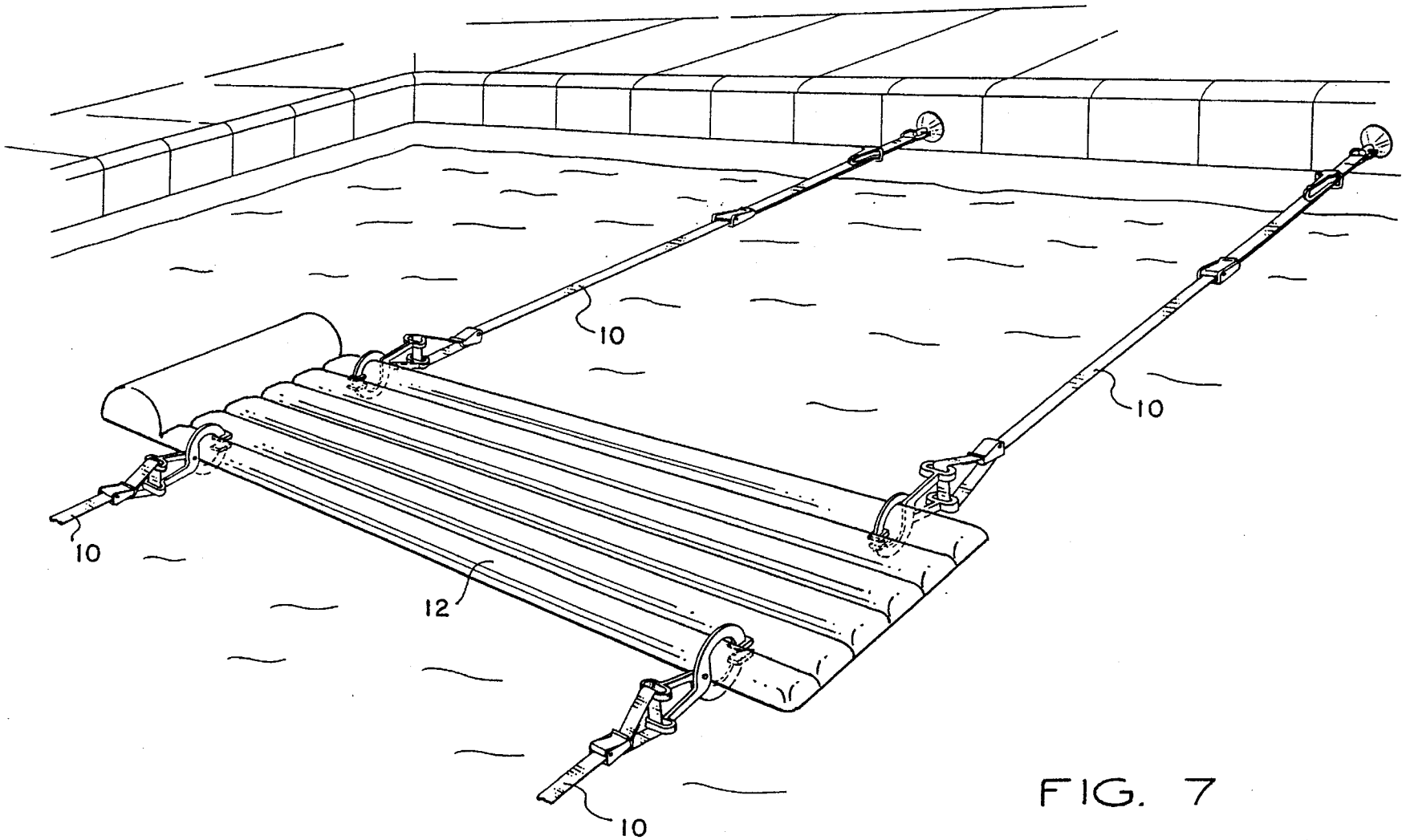
FIG. 7 is a view similar to FIG. 1 wherein an inflatable air mattress is illustrated.

As shown in FIG. 7, the improved apparatus of the present invention is also usable with devices such as inflatable mattresses as well as the closed-cell foam pads shown in the prior drawings. It will be appreciated that the unique construction of attachment clamp 28 permits a wide variety of flotation devices to be attached, with the clamping force modulated by the positioning of first buckle 60. In other words, if a relatively thin flotation device is utilized, first buckle 60 is drawn up close to strap attachment loops to effect a tight engagement. On the other hand, if a relatively thick flotation device is utilized, then first buckle 60 will be engaged to form a slightly larger first loop 62.

Whereas the present invention has been described with respect to a specific embodiment thereof, it will be understood that various changes and modifications will be suggested to one skilled in the art, and it is intended to encompass such changes and modifications as fall within the scope of the appended claims.

I claim:

1. An improved apparatus for anchoring a flotation device, comprising: a strap member having two ends;

an attachment clamp connected to one end of said strap and having opposed clamp surfaces for clamping said flotation device;

an anchoring device fixed to said other end of said strap; and with each clamp surface being block-shaped and having a plurality of longitudinal ridges to enhance the gripping ability thereof.

2. An improved apparatus for anchoring a flotation device, comprising:

a strap member having two ends;

an attachment clamp connected to one end of said strap and having opposed clamp surfaces for clamping said flotation device;

an anchoring device fixed to said other end of said strap;

with said attachment clamp having first and second identical scissors members joined side-by-side by a hinge;

with each scissors member having two ends, and each scissors member including one of said clamp surfaces at one end and a strap attachment loop at said other end, said hinge being intermediate said ends;

with each scissors member having an arm extending from said hinge to said strap attachment loop at said other end; and with said strap attachment loop being oblong in a direction perpendicular to said arm and parallel to said hinge.

3. The apparatus of claim 10 with said strap attachment loop being connected to said arm at a location offset from the middle of said strap attachment loop such that openings in said strap attachment loops are aligned.

4. The apparatus of claim 2 with said strap member being threaded through said strap attachment loops and terminating at its first end at a readily-disengageable first buckle, said first buckle being slidably-engaged with said body of said strap member to form an adjustable first loop through said strap attachment loops, such that the maximum opening between said opposed clamp surfaces is defined by the position of said first buckle with respect to said body of said strap member.

5. The apparatus of claim 4 with said anchoring device threaded onto said second loop, said anchoring device, with the overall length of said strap member between said anchoring device and said attachment clamp being defined by the position of said second buckle with respect to said body of said strap member.

6. An improved apparatus for anchoring a flotation device, comprising:

a strap member having two ends;

an attachment clamp connected to one end of said strap and having opposed clamp surfaces for clamping said flotation device;

an anchoring device fixed to said other end of said strap;

where said strap member is a fabric web strap having a body and first and second ends; and with said strap member terminating at its second end at a readily-disengageable second buckle slidably-engaged with said body of said strap to form an adjustable second loop.

7. An improved apparatus for anchoring a flotation device, comprising:

a fabric web strap member having a body and first and second ends;

an attachment clamp connected to said first end of said strap member and having opposed clamp surfaces for clamping said flotation device;

said attachment clamp having first and second identical scissors members joined side-by-side by a hinge;

each scissors member formed of thermoplastic;

each scissors member having two ends;

each scissors member including one of said clamp surfaces at one end and a strap attachment loop at said other end, said hinge being intermediate said ends;

each clamp surface being block-shaped and having a plurality of longitudinal ridges to enhance the gripping ability thereof;

each scissors member further including a curved clearance portion extending outwardly from said clamp surface and curving inwardly to said hinge, said clearance portion having circular inner and outer surfaces and parallel, planar side surfaces;

said clearance portions being-angled slightly inwardly from said hinge such that said clamp surfaces are opposed;

each scissors member having an arm extending from said hinge to said strap attachment loop at said other end;

said strap attachment loop being oblong in a direction perpendicular to said arm and parallel to said hinge;

said strap attachment loop being connected to said arm at a location offset from the middle of said strap attachment loop such that openings in said strap attachment loops are aligned;

said strap member being threaded through said strap attachment loops and terminating at its first end at a readily-disengageable first buckle, said first buckle being slidably-engaged with said body of said strap member to form an adjustable first loop through said strap attachment loops, such that the maximum opening between said opposed clamp surfaces is defined by the position of said first buckle with respect to said body of said strap member;

said strap member terminating at its second end at a readily-disengageable second buckle slidably-engaged with said body of said strap member to form an adjustable second loop; and two anchoring devices threaded onto said second loop, said anchoring devices including a suction cup and a snap hook, with the overall length of said strap member between said anchoring devices and said attachment clamp being defined by the position of said second buckle with respect to said body of said strap member.

* * * * *